US011383537B2

(12) United States Patent
Ichikawa et al.

(10) Patent No.: US 11,383,537 B2
(45) Date of Patent: Jul. 12, 2022

(54) IMAGE RECORDING APPARATUS

(71) Applicant: Brother Kogyo Kabushiki Kaisha, Nagoya (JP)

(72) Inventors: Shohei Ichikawa, Kasugai (JP); Tsuyoshi Ito, Nagoya (JP); Keisuke Wakakusa, Nagoya (JP); Yoshimitsu Taniguchi, Tajimi (JP); Masatake Sato, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 247 days.

(21) Appl. No.: 16/797,162

(22) Filed: Feb. 21, 2020

(65) Prior Publication Data

US 2020/0276841 A1 Sep. 3, 2020

(30) Foreign Application Priority Data

Feb. 28, 2019 (JP) ..... JP2019-035512

(51) Int. Cl.

| | |
|---|---|
| ***B41J 13/00*** | (2006.01) |
| ***B41J 13/03*** | (2006.01) |
| ***B65H 1/04*** | (2006.01) |
| ***B65H 29/12*** | (2006.01) |
| ***B41J 11/04*** | (2006.01) |

(52) U.S. Cl.

CPC ..... *B41J 13/0018* (2013.01); *B41J 11/04* (2013.01); *B41J 13/03* (2013.01); *B65H 1/04* (2013.01); *B65H 29/12* (2013.01); *B65H 2513/106* (2013.01); *B65H 2513/108* (2013.01); *B65H 2513/21* (2013.01); *B65H 2513/22* (2013.01); *B65H 2513/41* (2013.01)

(58) Field of Classification Search

CPC ..... B41J 3/03; B41J 13/0018; B41J 13/03; B65H 2513/106; B65H 2513/108; B65H 13/21; B65H 13/22; B65H 2513/41; B65H 2513/514; B65H 1/04

See application file for complete search history.

(56) References Cited

U.S. PATENT DOCUMENTS

2016/0052311 A1* 2/2016 Taniguchi ..... B41J 11/0095 347/16

FOREIGN PATENT DOCUMENTS

JP 2001-191601 A 7/2001

* cited by examiner

*Primary Examiner* — Matthew Luu
*Assistant Examiner* — Kendrick X Liu
(74) *Attorney, Agent, or Firm* — Banner & Witcoff, Ltd.

(57) ABSTRACT

A controller determines whether, in a case where feeding of a subsequent sheet is performed in a first feed condition, a subsequent sheet contacts conveyance rollers during recording on a preceding sheet, the first feed condition being that feeding of the subsequent sheet is started at a first timing before recording on the preceding sheet ends and that the subsequent sheet is fed at a first velocity, and in response to determining that the subsequent sheet contacts the conveyance rollers during recording on the preceding sheet, controls the feed roller to perform feeding of the subsequent sheet in a second feed condition or a third feed condition, the second feed condition being that the feeding of the subsequent sheet is started at a second timing later than the first timing, the third feed condition being that the subsequent sheet is fed at a second velocity lower than the first velocity.

19 Claims, 10 Drawing Sheets

IMAGE RECORDING APPARATUS

CROSS REFERENCE TO RELATED APPLICATIONS

This application claims priority from Japanese Patent Application No. 2019-035512 filed Feb. 28, 2019. The entire content of the priority application is incorporated herein by reference.

TECHNICAL FIELD

This disclosure relates to an image recording apparatus.

BACKGROUND

The image recording apparatus records an image on a sheet as described below. A sheet supported on a tray is fed to a conveyance path in the apparatus by a feed roller. The sheet fed to the conveyance path is sent to a recording unit by a pair of conveyance rollers provided on the conveyance path, image recording is performed by the recording unit, and the sheet is discharged to outside the apparatus.

For image recording apparatuses, successive image recording of a plurality of sheets at higher speed is required. Thus, it is conceived that a feed roller starts feeding of a subsequent sheet immediately after the trailing end of a preceding sheet passes through the pair of conveyance rollers.

SUMMARY

According to one aspect, this specification discloses an image recording apparatus. The image recording apparatus includes a tray, a feed roller, a pair of conveyance rollers, a print engine, and a controller. The tray is configured to support sheets. The feed roller is configured to feed the sheets supported on the tray. The pair of conveyance rollers is located on a conveyance path through which sheets pass. The print engine is located downstream of the pair of conveyance rollers on the conveyance path in a conveyance direction of sheets. The controller is configured to: control the feed roller to rotate to perform feeding of a preceding sheet supported on the tray to the conveyance path; control the pair of conveyance rollers to rotate to convey the preceding sheet fed by the feed roller in a conveyance direction through the conveyance path; control the print engine to perform recording of an image on the preceding sheet that is conveyed by the pair of conveyance rollers; determine whether, in a case where feeding of a subsequent sheet is performed in a first feed condition, the subsequent sheet contacts the pair of conveyance rollers during the recording on the preceding sheet, the subsequent sheet being a sheet that is fed subsequent to the preceding sheet, the first feed condition being a condition that the feeding of the subsequent sheet is started at a first timing before the recording on the preceding sheet ends and that the subsequent sheet is fed at a first velocity; and in response to determining that the subsequent sheet contacts the pair of conveyance rollers during the recording on the preceding sheet, control the feed roller to perform the feeding of the subsequent sheet in one of a second feed condition and a third feed condition, the second feed condition being a condition that the feeding of the subsequent sheet is started at a second timing that is later than the first timing, the third feed condition being a condition that the subsequent sheet is fed at a second velocity that is lower than the first velocity.

BRIEF DESCRIPTION OF THE DRAWINGS

Embodiments in accordance with this disclosure will be described in detail with reference to the following figures wherein:

FIGS. 4A and 4B are schematic diagrams showing a transmission portion 74 and a transmission portion 85, wherein FIG. 4A shows a state where a conveyance motor 102 is rotated in a forward direction and FIG. 4B shows a state where the conveyance motor 102 is rotated in a reverse direction;

DETAILED DESCRIPTION

In an image recording apparatus, oblique-conveyance correction processing for a sheet is performed. The oblique-conveyance correction processing is performed by causing a fed sheet to be pushed and contact the pair of conveyance rollers that is in the reverse rotation (the rotation opposite the forward rotation for sending a sheet to the recording unit).

However, there is a possibility that the pair of conveyance rollers in reverse rotation vibrates due to contact with the sheet. This vibration may propagate to other members such as a recording unit that is connected to the pair of conveyance rollers through a frame or the like, and the entire apparatus may vibrate.

As in the above-mentioned image recording apparatus, if the feed roller starts feeding of the subsequent sheet immediately after the trailing end of the preceding sheet passes through the pair of conveyance rollers, there is a possibility that the subsequent sheet is pushed and contacts the pair of conveyance rollers during image recording of the preceding sheet, and the apparatus vibrates, which may affect the quality of the image recorded on the sheet.

In view of the foregoing, an example of an object of this disclosure is to provide an image recording apparatus configured to, when successive feeding is performed, prevent feeding and conveyance of a subsequent sheet from affecting the quality of an image recorded on a preceding sheet.

An aspect of this disclosure will be described.

In the following description, an upper-lower direction Z is defined in a state where a multifunction peripheral (MFP) 10 is placed to be usable (the state of FIG. 1), a front-rear direction Y is defined by defining the surface formed with an opening 13 as a front surface 104, and a left-right direction X is defined by viewing the MFP 10 from the front toward the rear. The upper-lower direction Z, the front-rear direction Y, and the left-right direction X are perpendicular to each other. In the present embodiment, the upper-lower direction Z is an example of a vertical direction, and each of the front-rear direction Y and the left-right direction X is an example of a horizontal direction.

[Overall Configuration of MFP 10]

Figure 1:
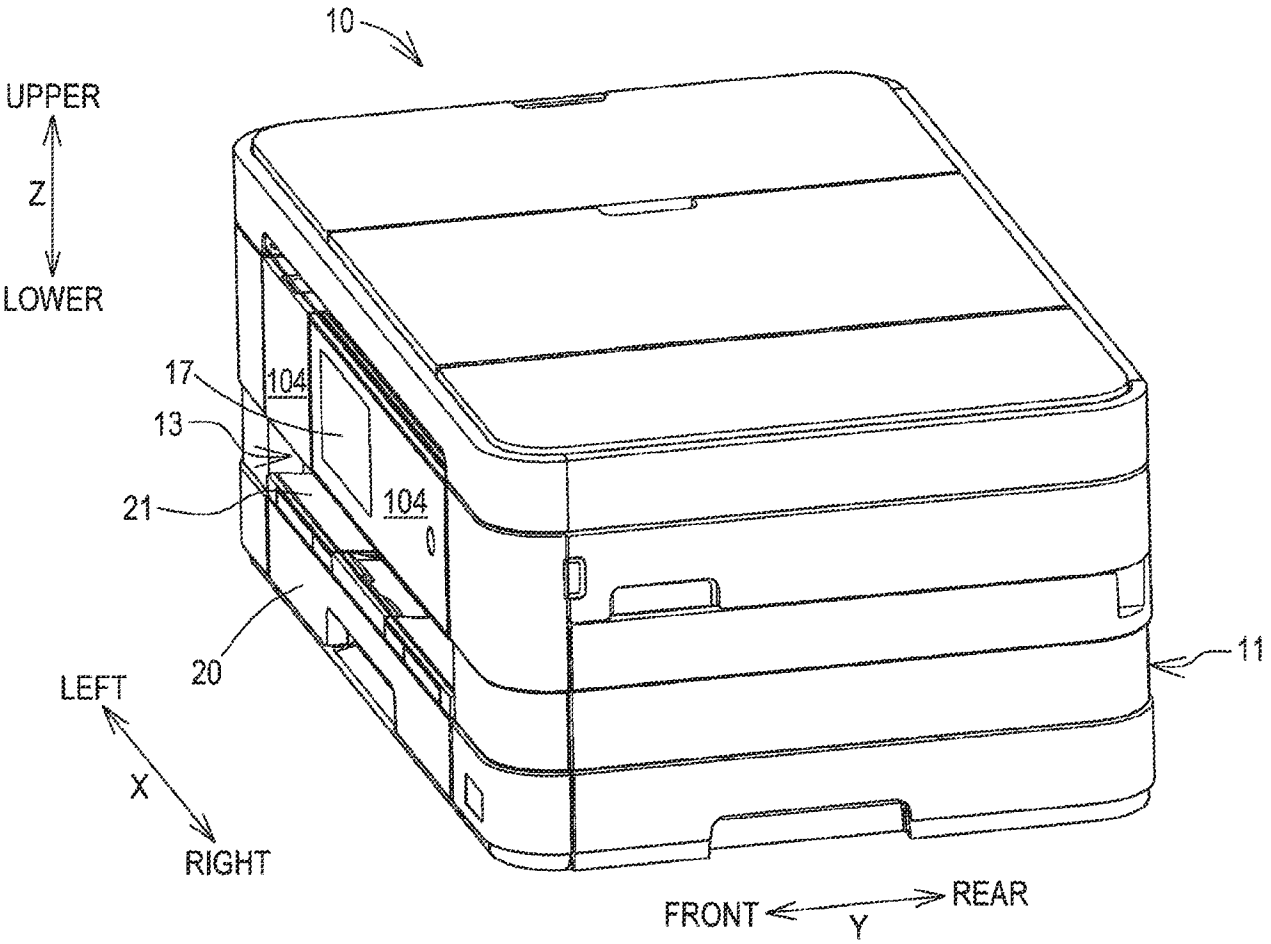
FIG. 1 is a perspective view of a multifunction peripheral (MFP) 10.

As shown in FIG. 1, the MFP 10 (an example of an image recording apparatus) is substantially formed in a rectangular parallelepiped shape. The MFP 10 includes, at a lower part thereof, a printer unit 11 that records an image on paper 12 (an example of a sheet, see FIG. 2) by an inkjet recording method. The MFP 10 has various functions such as a facsimile function and a print function.

Figure 2:
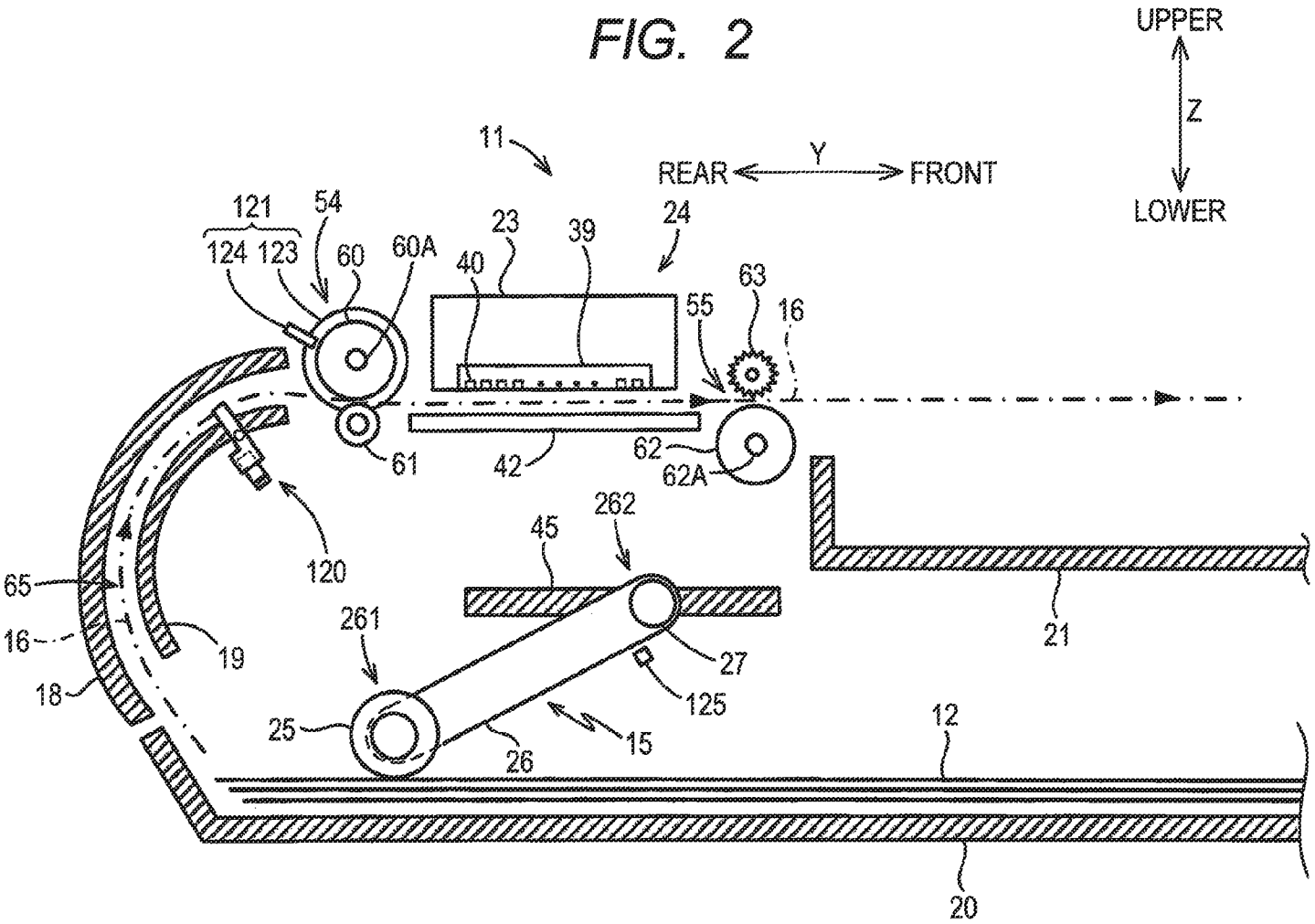
FIG. 2 is a vertical cross-sectional view schematically showing the internal structure of a printer unit 11.
Figure 6:
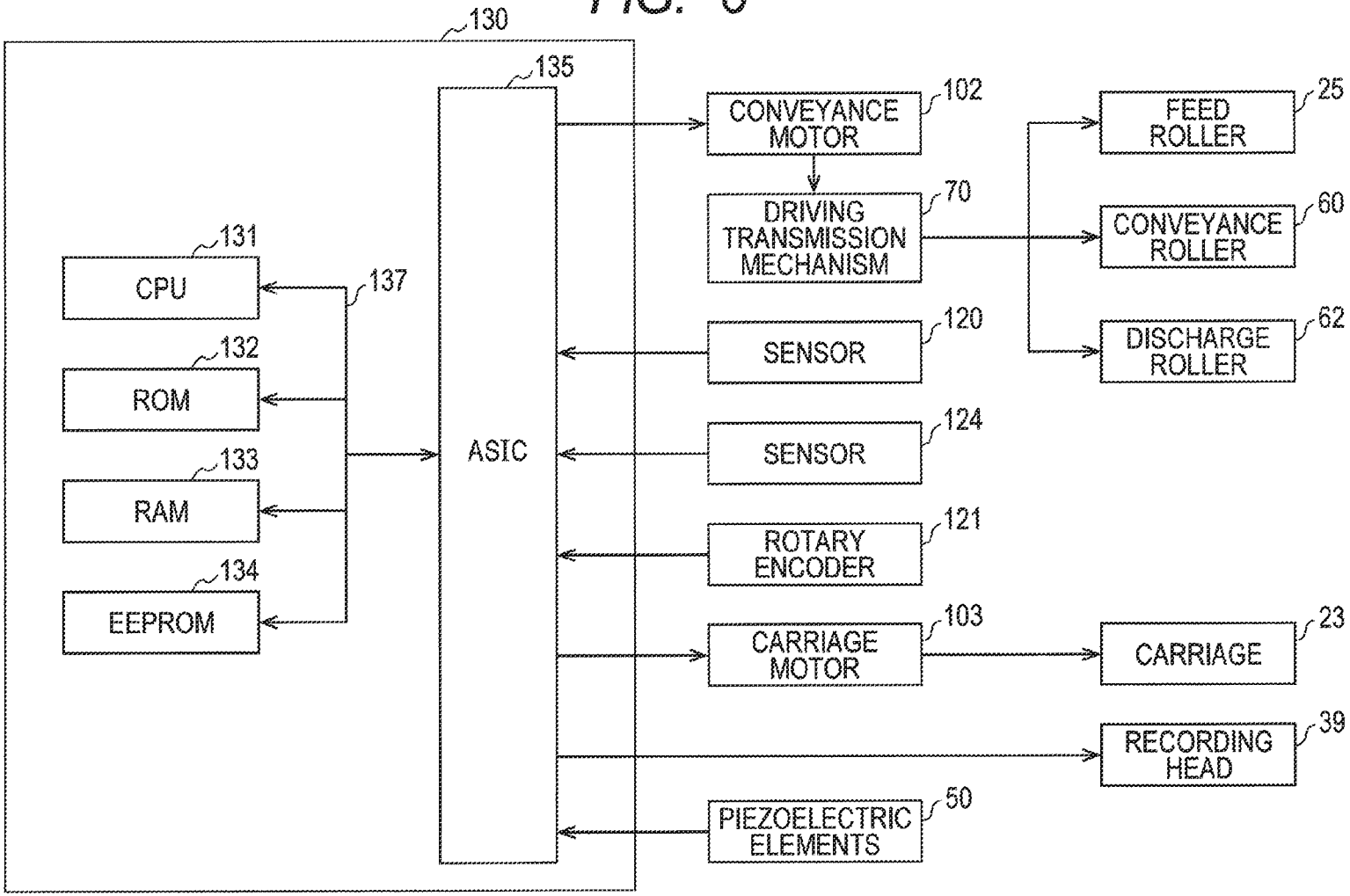
FIG. 6 is a functional block diagram of the printer unit 11.

As shown in FIG. 2, the printer unit 11 includes a feed tray 20 (an example of a tray), a discharge tray 21, a feed unit 15, a pair of conveyance rollers 54, a pair of discharge rollers 55, a recording unit 24 (an example of a print engine), a platen 42, a sensor 120, a sensor 125, a rotary encoder 121, a driving transmission mechanism 70 (see FIG. 6), and a controller 130 (see FIG. 6).

[Feed Tray 20, Discharge Tray 21]

As shown in FIGS. 1 and 2, the feed tray 20 is inserted rearward and pulled out forward through the opening 13 formed in the front surface of the printer unit 11. The feed tray 20 supports a plurality of sheets of paper 12 that is stacked. The discharge tray 21 is located above the feed tray 20. The discharge tray 21 supports paper 12 that has been discharged by the pair of discharge rollers 55 through the opening 13.

[Feed Unit 15]

As shown in FIG. 2, the feed unit 15 includes a feed roller 25, a feed arm 26 (an example of an arm), and a shaft 27.

The feed roller 25 is rotatably supported at a distal end portion 261 of the feed arm 26. The feed roller 25 contacts, from above, paper 12 when paper 12 is supported on the feed tray 20, and contacts, from above, a paper support surface of the feed tray 20 when no paper 12 is supported on the feed tray 20.

A base end portion 262 of the feed arm 26 is pivotally supported about the shaft 27 by a frame 45 (an example of a third frame) of the printer unit 11. The base end portion 262 is located at a farther forward and upward position than the distal end portion 261. That is, the feed arm 26 extends from the base end portion 262 toward the distal end portion 261 diagonally in a rearward (the feed direction of paper 12 by the feed roller 25) and downward direction.

The feed roller 25 rotates clockwise in FIG. 2 due to reverse rotation of the conveyance motor 102 (an example of a motor, see FIG. 6). With this configuration, the feed roller 25 conveys paper 12 supported on the feed tray 20 rearward, and feeds the paper 12 toward a conveyance path 65 described later.

The paper 12 fed to the conveyance path 65 is conveyed in a conveyance direction 16 along the conveyance path 65. The conveyance direction 16 is the direction along the conveyance path 65 and is shown by the arrow of the single-dot chain line in FIG. 2. The paper 12 conveyed in the conveyance direction 16 by the feed tray 20 moves toward the pair of conveyance rollers 54 located on the conveyance path 65.

[Conveyance Path 65]

As shown in FIG. 2, the conveyance path 65 through which paper 12 passes is formed within the printer unit 11. The conveyance path 65 includes a space formed between guide members 18, 19 that face each other with a particular interval therebetween within the printer unit 11 and a space formed between the recording unit 24 and the platen 42.

The conveyance path 65 is formed by a curved conveyance path that extends while being curved and a linear conveyance path that extends linearly. The curved conveyance path is a path that makes a U-turn while extending upward from below at the rear of the printer unit 11. The linear conveyance path is a path extending from the pair of conveyance rollers 54, passing through the recording unit 24, and reaching the discharge tray 21. The pair of conveyance rollers 54 and the pair of discharge rollers 55 of the present embodiment are located on the linear conveyance path of the conveyance path 65.

Note that the conveyance path 65 is not limited to the configuration formed by the curved conveyance path and the linear conveyance path shown in FIG. 2. For example, the conveyance path 65 may be formed only by a linear conveyance path.

[Pair of Conveyance Rollers 54 and Pair of Discharge Rollers 55]

As shown in FIG. 2, the pair of conveyance rollers 54 is located on the linear conveyance path of the conveyance path 65. The pair of conveyance rollers 54 includes a conveyance roller 60 (an example of a roller) and a pinch roller 61 facing each other. The conveyance roller 60 is driven by the conveyance motor 102 (see FIG. 6). The pinch roller 61 rotates by following rotation of the conveyance roller 60.

The pair of discharge rollers 55 is located downstream of the pair of conveyance rollers 54 in the conveyance direction 16 along the conveyance path 65. The pair of discharge rollers 55 includes a discharge roller 62 and a spur 63 facing each other. The discharge roller 62 is driven by the conveyance motor 102 (see FIG. 6). The spur 63 rotates by following rotation of the discharge roller 62.

Figure 5:
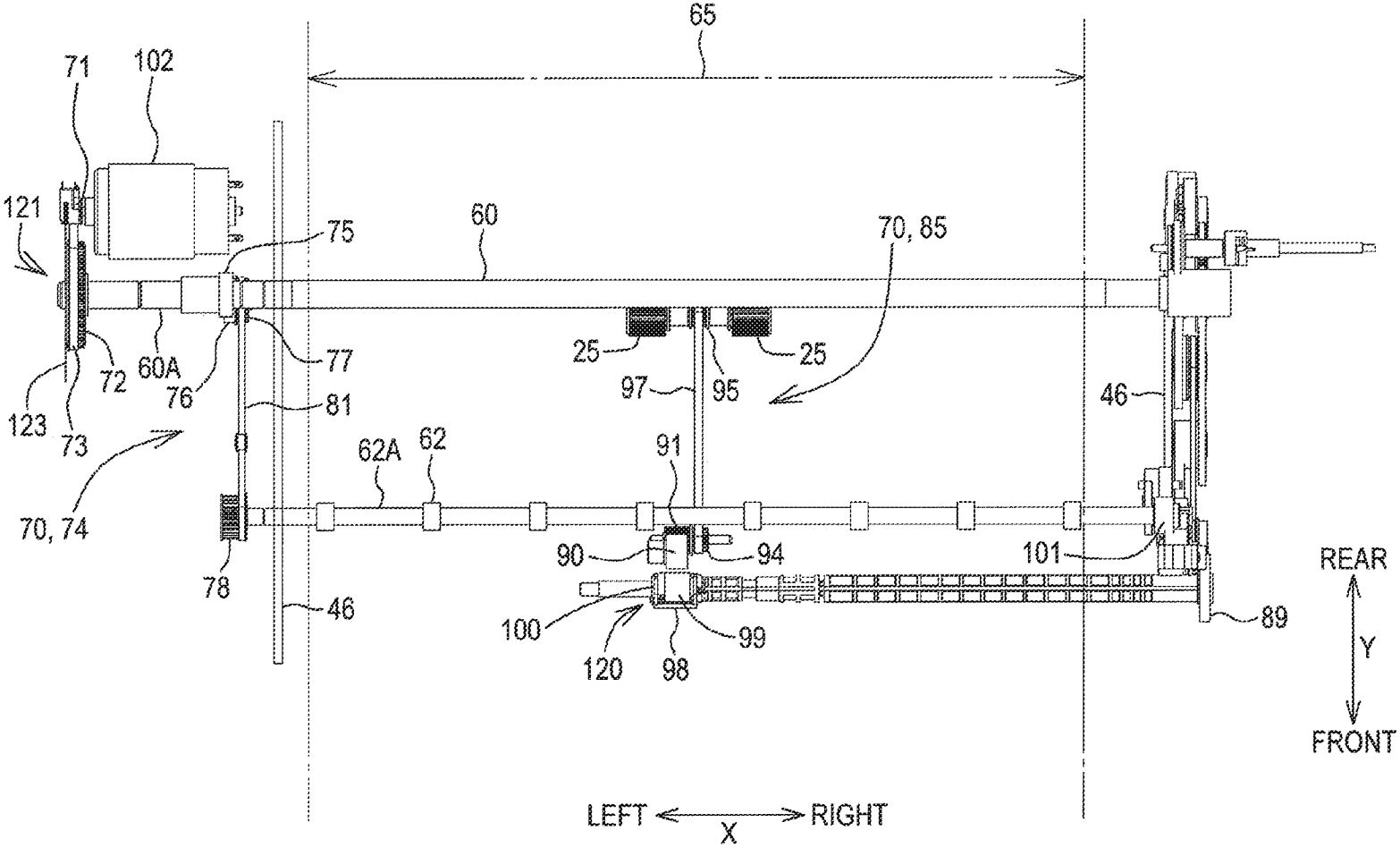
FIG. 5 is a plan view of a driving transmission mechanism 70 and each roller 60, 62.

As shown in FIG. 5, the right end portion and the left end portion of each of the conveyance roller 60 and the discharge roller 62 are rotatably supported by a pair of side frames 46 (an example of a first frame). The pair of side frames 46 is arranged to face each other in the left-right direction X. One of the pair of side frames 46 supports the right end portion of each of the conveyance roller 60 and the discharge roller 62, and the other one of the pair of side frames 46 supports the left end portion of each of the conveyance roller 60 and the discharge roller 62.

The pair of side frames 46 is coupled to the above-described frame 45 (see FIG. 2). Specifically, the right end portion of the frame 45 is coupled to one of the pair of side frames 46, and the left end portion of the frame 45 is coupled to the other one of the pair of side frames 46. Alternatively, the pair of side frames 46 and the frame 45 may be formed in one-piece molding (integrally formed).

Each of the pair of conveyance rollers 54 and the pair of discharge rollers 55 nippingly holds and conveys paper 12.

Each of the conveyance roller 60 and the discharge roller 62 is rotatable in the direction of conveying paper 12 in the conveyance direction 16 and the direction opposite that direction (in other words, the direction of conveying paper 12 oppositely from the conveyance direction 16). In the following description, among rotations of the conveyance roller 60 and the discharge roller 62, the rotation of conveying paper 12 in the conveyance direction 16 is referred to as "forward rotation". Further, among rotations of the conveyance roller 60 and the discharge roller 62, the rotation in the opposite direction from the forward rotation is referred to as "reverse rotation".

[Recording Unit 24]

As shown in FIG. 2, the recording unit 24 is located on the linear conveyance path of the conveyance path 65. In the present embodiment, the recording unit 24 is located on the linear conveyance path between the pair of conveyance rollers 54 and the pair of discharge rollers 55.

The recording unit 24 is provided above the platen 42 and faces the platen 42. The platen 42 supports, from below, paper 12 that is conveyed by the pair of conveyance rollers 54. The recording unit 24 includes a carriage 23 and a head 39.

Figure 3:
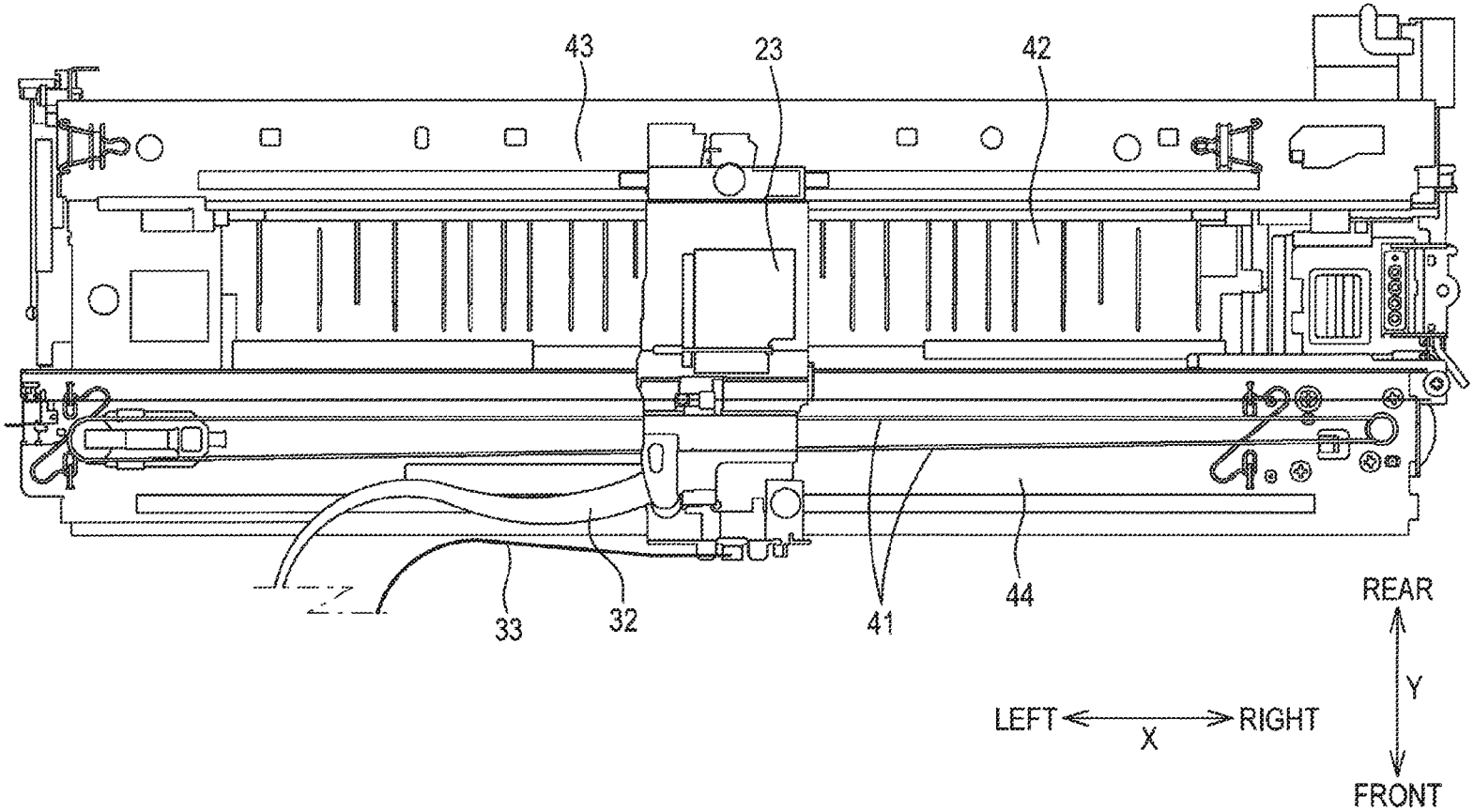
FIG. 3 is a plan view of a carriage 23 and guide rails 43, 44.

As shown in FIG. 3, an ink tube 32 and a flexible flat cable 33 extend from the carriage 23. The ink tube 32 supplies ink in an ink cartridge to the head 39. The flexible flat cable 33 electrically connects the head 39 and a control board on which the controller 130 (see FIG. 6) is mounted.

The carriage 23 is supported by guide rails 43, 44 (an example of a second frame). The guide rails 43, 44 are arranged spaced from each other in the front-rear direction Y. Each of the guide rails 43, 44 extends in the left-right direction X. The carriage 23 is coupled to a known belt mechanism 41 provided at the guide rail 44. The belt mechanism 41 circuitously moves by driving of a carriage motor 103 (see FIG. 6). The circuitous movement of the belt mechanism 41 causes the carriage 23 to move along the left-right direction X (an example of a scanning direction). The moving direction of the carriage 23 is not limited to the left-right direction X, but may be any direction that is parallel to an imaginary surface extending in the front-rear direction Y and in the left-right direction X (a horizontal surface in the present embodiment) and that intersects the conveyance direction 16.

Each of the guide rails 43, 44 is coupled to the pair of side frames 46 (see FIG. 5). Specifically, one of the pair of side frames 46 supports the guide rails 43, 44 in a state where the side frame 46 is coupled to the right end portion of the guide rails 43, 44, and the other one of the pair of side frames 46 supports the guide rails 43, 44 in a state where the side frame 46 is coupled to the left end portion of the guide rails 43, 44.

Alternatively, the guide rails 43, 44 and the pair of side frames 46 may be molded as an integral part (may be formed integrally).

As shown in FIG. 2, the head 39 is mounted on the carriage 23. The head 39 includes a plurality of subsidiary tanks (not shown), a plurality of nozzles 40, ink channels (not shown), and piezoelectric elements 50 (see FIG. 6).

Ink is supplied to the plurality of subsidiary tanks from ink cartridges (not shown) and ink tanks (not shown). The plurality of nozzles 40 opens in the lower surface of the head 39. The ink channels connect the plurality of subsidiary tanks with the plurality of nozzles 40. The piezoelectric elements 50 shown in FIG. 6 cause parts of the ink channels to deform so as to eject ink droplets from the nozzles 40. The piezoelectric elements 50 operate by being supplied with electric power from the controller 130 (see FIG. 6), and the operation of the piezoelectric elements 50 causes the nozzles 40 to eject ink droplets. In the process in which the carriage 23 moves, the head 39 ejects ink droplets onto paper 12 supported by the platen 42. In this way, an image is recorded on paper 12.

[Sensor 120]

As shown in FIG. 2, the sensor 120 is located on the conveyance path 65 upstream of the pair of conveyance rollers 54 in the conveyance direction 16. The sensor 120 is a sensor for detecting that paper 12 exists at an arrangement position where the sensor 120 is arranged, and a known sensor may be adopted. The paper 12 conveyed by the feed unit 15 passes the arrangement position of the sensor 120 and reaches the pair of conveyance rollers 54. In a case where paper 12 exists at the arrangement position, the sensor 120 outputs one of a high-level signal and a low-level signal (in the present embodiment, the low-level signal) to the controller 130 (see FIG. 6). In a case where paper 12 does not exist at the arrangement position, the sensor 120 outputs the other one of a high-level signal and a low-level signal (in the present embodiment, the high-level signal) to the controller 130 (see FIG. 6).

[Sensor 125]

As shown in FIG. 2, the sensor 125 is disposed adjacent to the feed arm 26. In the present embodiment, the sensor 125 is a proximity sensor.

In a case where the distance from the feed arm 26 is smaller than a particular distance, the sensor 125 outputs one of a high-level signal and a low-level signal (in the present embodiment, the high-level signal) to the controller 130. In a case where the distance from the feed arm 26 is larger than or equal to the particular distance, the sensor 125 outputs the other one of the high-level signal and the low-level signal (in the present embodiment, the low-level signal) to the controller 130.

As the stacked amount of paper 12 on the feed tray 20 becomes larger, the feed arm 26 pivotally moves upward and the distance from the sensor 125 becomes longer. That is, in a case where the amount of paper 12 stacked on the feed tray 20 is smaller than a set amount, the sensor 125 outputs one of the high-level signal and the low-level signal (in the present embodiment, the high-level signal) to the controller 130. In a case where the amount of paper 12 stacked on the feed tray 20 is larger than or equal to the set amount, the sensor 125 outputs the other one of the high-level signal and the low-level signal (in the present embodiment, the low-level signal) to the controller 130. The set amount is preliminarily set depending on a slip occurrence rate (the rate of an occurrence of a slip between the feed roller 25 and paper 12) at the time of start of rotation of the feed roller 25 (the slip occurrence rate is obtained from experiments in which the feed roller 25 is rotated). The slip occurrence rate is higher as the stacked amount of paper 12 on the feed tray 20 is smaller. For example, the set amount is preliminarily set to one fifth (⅕) of the maximum amount of paper 12 that can be stacked on the feed tray 20.

The sensor 125 is not limited to a proximity sensor, and any known sensor may be adopted. For example, the sensor 125 may be a sensor configured to output a signal depending on the weight of paper 12 stacked on the feed tray 20.

[Rotary Encoder 121]

As shown in FIG. 2, the printer unit 11 includes the known rotary encoder 121 configured to generate pulse signals depending on rotation of the conveyance roller 60. The rotary encoder 121 includes an encoder disk 123 and an optical sensor 124. The encoder disk 123 rotates together with rotation of the conveyance roller 60. The optical sensor 124 reads the encoder disk 123 that is rotating, generates a pulse signal, and outputs the generated pulse signal to the controller 130. Alternatively, the rotary encoder 121 may be configured to generate pulse signals depending on rotation of the conveyance motor 102. In this case, the encoder disk 123 is attached to the shaft of the conveyance motor 102.

[Driving Transmission Mechanism 70]

As shown in FIG. 6, the driving transmission mechanism 70 transmits the driving force of the conveyance motor 102 to the feed roller 25, the conveyance roller 60, and the discharge roller 62. The driving transmission mechanism 70 is formed by combining all or a part of a gear, a pulley, an endless belt, and a planetary gear mechanism.

Figure 4B:
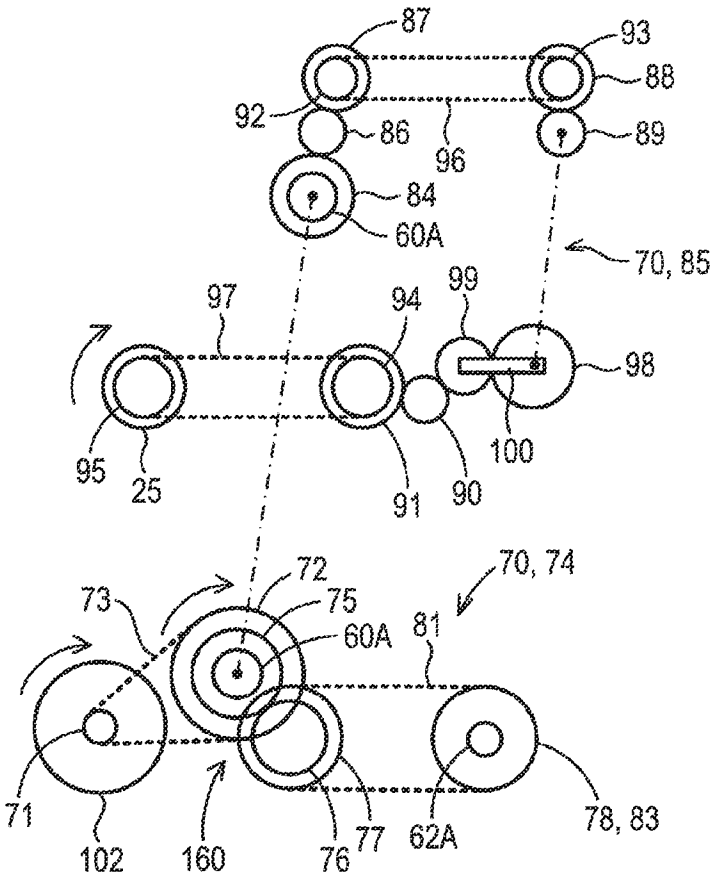
Figure 4A:
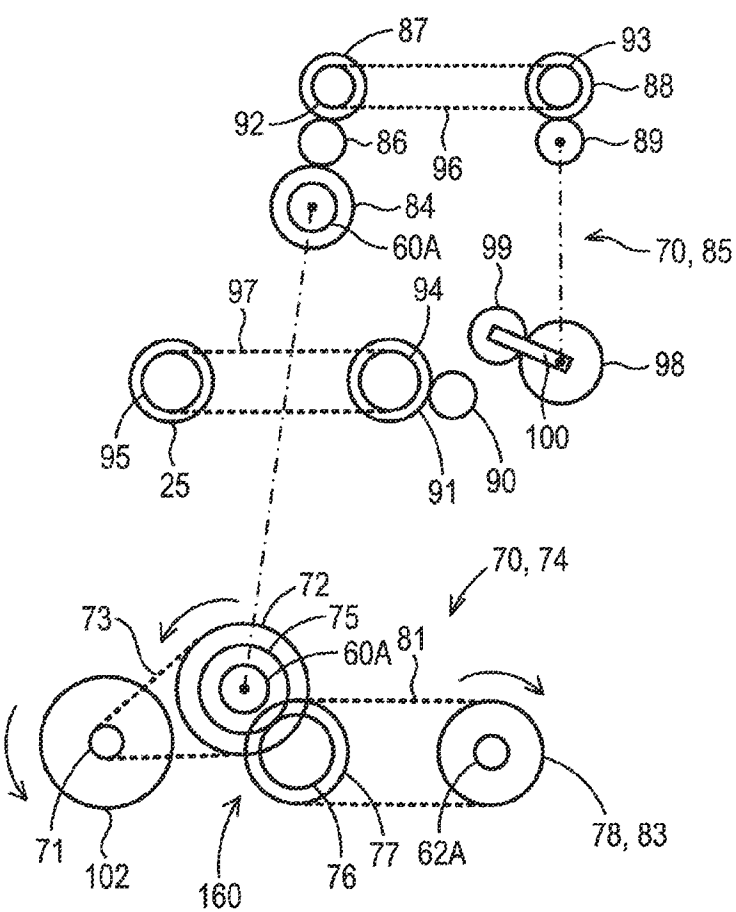

As shown in FIGS. 4A, 4B, and 5, the driving transmission mechanism 70 includes a pulley 71 that rotates together with the shaft of the conveyance motor 102, a pulley 72 that rotates together with a shaft 60A of the conveyance roller 60, and an endless belt 73 looped around the pulleys 71, 72. With this configuration, the conveyance roller 60 rotates in the forward direction by receiving the driving force of forward rotation of the conveyance motor 102, and rotates in the reverse direction by receiving the driving force of reverse rotation of the conveyance motor 102. The conveyance roller 60 rotates in the forward direction so as to convey paper 12 nipped between the pinch roller 61 and the conveyance roller 60 in the conveyance direction 16. Alternatively, the driving transmission mechanism 70 may be so configured that the conveyance roller 60 does not rotate (stops) when the reverse rotation of the conveyance motor 102 is transmitted.

As shown in FIG. 5, the driving transmission mechanism 70 includes transmission portions 74, 85 configured to transmit rotation of the conveyance motor 102 to the feed roller 25 and the discharge roller 62 through the shaft 60A of the conveyance roller 60. Note that the specific configuration of transmitting rotation of the conveyance motor 102 to the feed roller 25, the conveyance roller 60, and the discharge roller 62 is not limited to the example described below.

[Transmission Portion 74]

The transmission portion 74 shown in FIGS. 4A, 4B, and 5 transmits the driving force of forward rotation of the conveyance motor 102 from the conveyance roller 60 to the discharge roller 62. As shown in FIG. 5, the transmission portion 74 is provided at the left side of the conveyance path 65. The position of the transmission portion 74 is not limited to the position shown in FIG. 5. For example, the transmission portion 74 may be provided at the right side of the conveyance path 65.

As shown in FIGS. 4A, 4B, and 5, the transmission portion 74 includes gears 75, 76 engaging each other, pulleys 77, 78, and an endless belt 81.

The gear 75 engages the gear 76, and rotates together with the shaft 60A of the conveyance roller 60. The gear 76 and the pulley 77 rotate together and coaxially.

The pulley 78 is attached to the outside of a shaft 62A of the discharge roller 62. The pulley 78 is rotatable about the shaft 62A. When the pulley 78 rotates, the discharge roller 62 rotates together with the pulley 78. The pulley 78 includes a one-way clutch 83. When the forward rotation of the conveyance motor 102 is transmitted, the one-way clutch 83 causes the discharge roller 62 to rotate together with the pulley 78. That is, the one-way clutch 83 transmits, to the shaft 62A of the discharge roller 62, the forward rotation of the conveyance motor 102 transmitted to the pulley 78. On the other hand, when the reverse rotation of the conveyance motor 102 is transmitted, the one-way clutch 83 causes the pulley 78 to rotate idly relative to the discharge roller 62. That is, the one-way clutch 83 does not transmit, to the shaft 62A of the discharge roller 62, the reverse rotation of the conveyance motor 102 transmitted to the pulley 78.

The belt 81 is looped around the pulleys 77, 78.

As shown in FIG. 4A, the transmission portion 74 transmits the forward rotation of the conveyance motor 102 from the conveyance roller 60 to the discharge roller 62, thereby causing the discharge roller 62 to rotate in the forward direction. The forward rotation of the discharge roller 62 is indicated by the arrow shown at the outside of the discharge roller 62. On the other hand, as shown in FIG. 4B, the transmission portion 74 does not transmit the reverse rotation of the conveyance motor 102 from the conveyance roller 60 to the discharge roller 62.

In this way, when the forward rotation of the conveyance motor 102 is transmitted through the transmission portion 74, the discharge roller 62 rotates in the direction of conveying paper 12 nipped with the spur 63 in the conveyance direction 16. With this operation, the paper 12 is discharged onto the discharge tray 21.

[Transmission Portion 85]

The transmission portion 85 shown in FIGS. 4A and 4B transmits, to the feed roller 25, rotation of the conveyance motor 102 transmitted through the shaft 60A of the conveyance roller 60. As shown in FIGS. 4A and 4B, the transmission portion 85 includes gears 84, 86 to 91, pulleys 93 to 95, endless belts 96, 97, a sun gear 98, a planetary gear 99, and an arm 100.

The gear 84 rotates together with the shaft 60A. The gear 86 engages the gear 84. The gear 87 engages the gear 86. The gear 87 and the pulley 92 rotate together and coaxially. The gear 88 and the pulley 93 rotate together and coaxially. The gear 89 engages the gear 88. The sun gear 98 and the gear 89 rotate together and coaxially. The planetary gear 99 engages the sun gear 98, and makes contact with and separates from the gear 90. One end of the arm 100 is rotatably supported at the sun gear 98, and the other end of the arm 100 supports the planetary gear 99 such that the planetary gear 99 rotates and revolves around the sun gear 98. With this configuration, due to rotation of the sun gear 98, the planetary gear 99 revolves around the sun gear 98 while rotating. The gear 90 engages the gear 91. The gear 91 and the pulley 94 rotate together and coaxially. The pulley 95 and the feed roller 25 rotate together and coaxially. The belt 96 is looped around the pulleys 92, 93. The belt 97 is looped around the pulleys 94, 95.

As shown in FIG. 4A, when the driving force of forward rotation of the conveyance motor 102 is transmitted to the sun gear 98, the planetary gear 99 separates from the gear 90. Consequently, the transmission portion 85 does not transmit the driving force of forward rotation of the conveyance motor 102 to the feed roller 25. That is, at this time, the feed roller 25 is stopped.

As shown in FIG. 4B, when the driving force of reverse rotation of the conveyance motor 102 is transmitted to the sun gear 98, the planetary gear 99 engages the gear 90. Consequently, the transmission portion 85 transmits the driving force of reverse rotation of the conveyance motor 102 to the feed roller 25. With this configuration, the feed roller 25 rotates so as to convey paper 12 supported on the feed tray 20 rearward and to feed the paper 12 toward the conveyance path 65.

[Controller 130]

As shown in FIG. 6, the controller 130 includes a CPU 131, a ROM 132, a RAM 133, an EEPROM 134, and an ASIC 135, which are connected by an internal bus 137 with one another. The ROM 132 stores programs and so on for the CPU 131 to control various operations. The RAM 133 is used as a storage area for temporarily storing data, signals, and so on that are used when the CPU 131 executes the programs, or as a work area of data processing. The EEPROM 134 stores setting, flags, and so on that should be kept after power off.

The conveyance motor 102 and the carriage motor 103 are connected to the ASIC 135. The ASIC 135 generates a driving signal for rotating each motor, and controls each motor based on this driving signal. Each motor rotates in the forward direction or in the reverse direction, based on the driving signal from ASIC 135. For example, the controller 130 controls driving of the conveyance motor 102 to drive each roller. Further, the controller 130 controls driving of the carriage motor 103 to move the carriage 23 reciprocatingly.

The sensor 120, the sensor 125, and the rotary encoder 121 are connected to the ASIC 135. Based on a detection signal outputted from the sensor 120, the controller 130 detects that paper 12 exists at the position where the sensor 120 is arranged. Based on a signal outputted from the sensor 125, the controller 130 determines whether the stacked amount of paper 12 on the feed tray 20 is larger than or equal to a set amount. Based on the detection signal outputted from the sensor 120 and a pulse signal outputted from the rotary encoder 121, the controller 130 detects the position of paper 12.

The piezoelectric elements 50 are connected to the ASIC 135. The piezoelectric elements 50 operate by being supplied with electric power by the controller 130 through a drive circuit (not shown). The controller 130 controls electric supply to the piezoelectric elements 50 so as to eject ink droplets selectively from the plurality of nozzles 40.

[Image Recording Processing]

Figure 7:
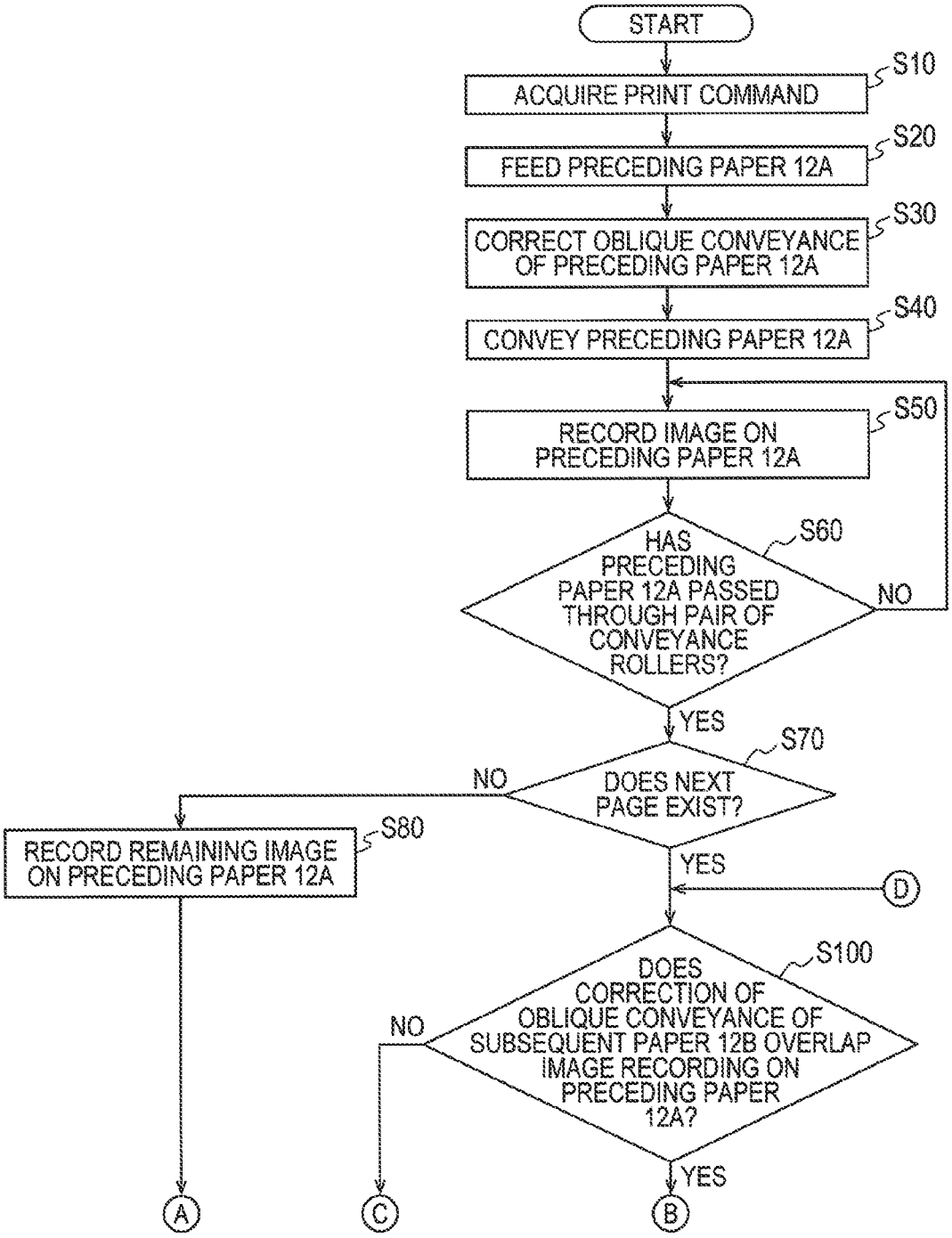
FIG. 7 is a flowchart of a part of image recording processing.
Figure 8:
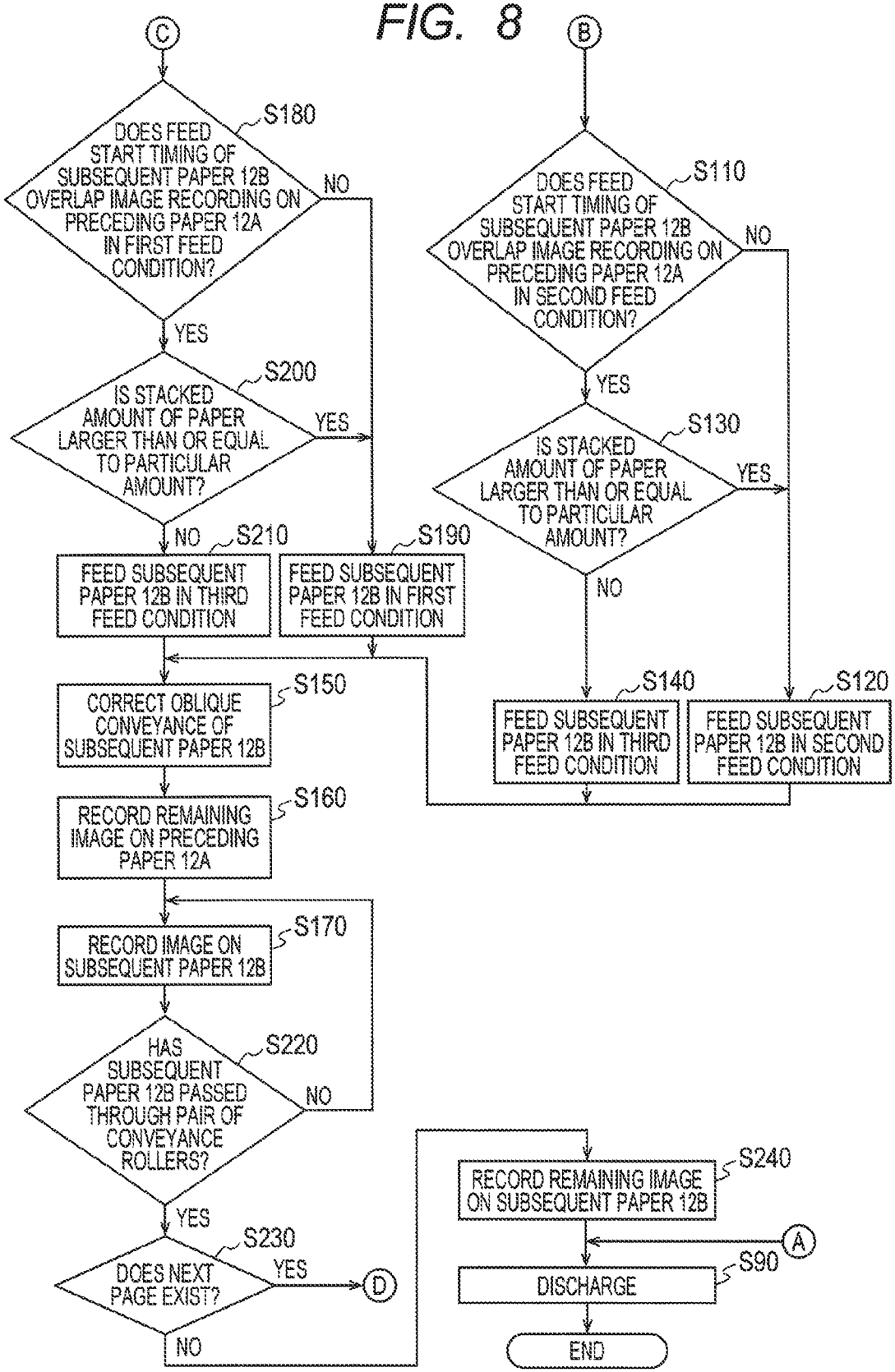
FIG. 8 is a flowchart of a remaining part of the image recording processing.

Hereinafter, image recording processing in the present embodiment will be described while referring to the flowcharts of FIGS. 7 and 8 and the timing charts of FIGS. 9 and 10. The image recording processing is executed by the CPU 131 of the controller 130. Each processing below may be executed by reading out programs stored in the ROM 132 by the CPU 131, or may be realized by a hardware circuit provided in the controller 130.

Figure 9:
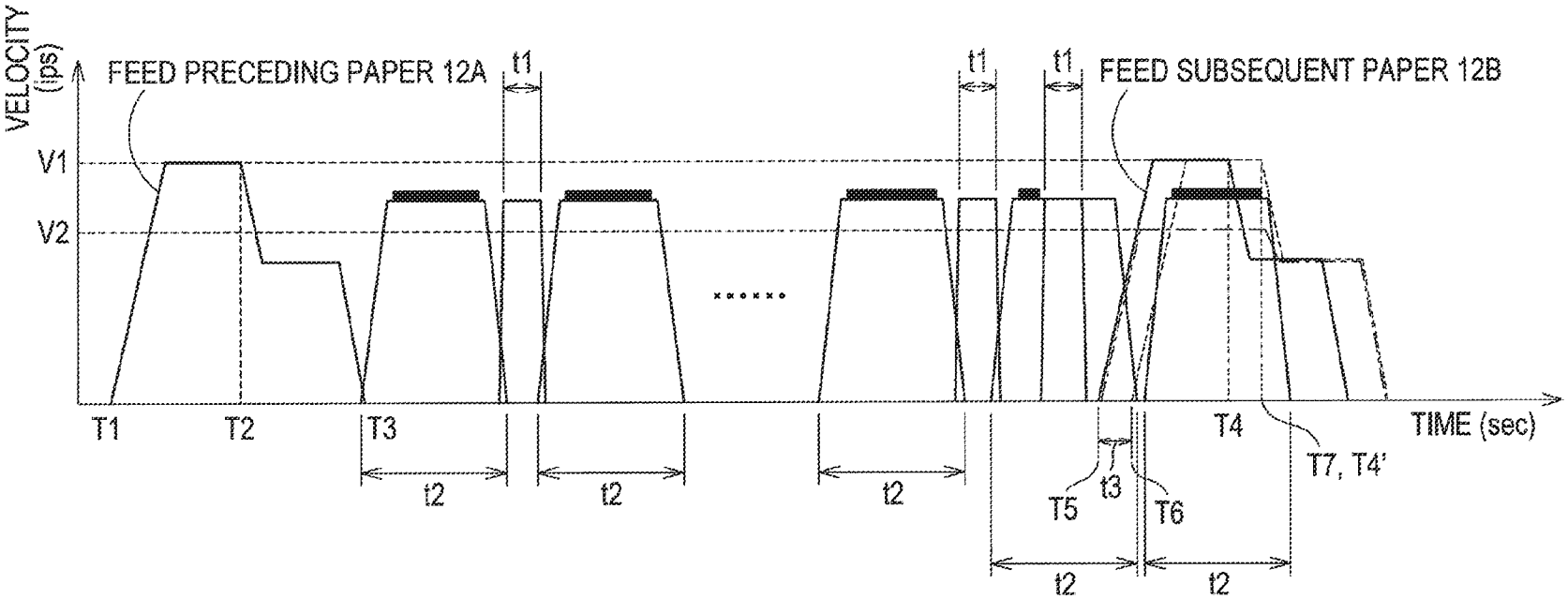
FIG. 9 is a timing chart showing velocities of a feed roller 25, a conveyance roller 60, and the carriage 23 with respect to time from the start of image recording processing in a case where the timing at which subsequent paper 12B contacts a pair of conveyance rollers 54 is during ejection processing on preceding paper 12A.
Figure 10:
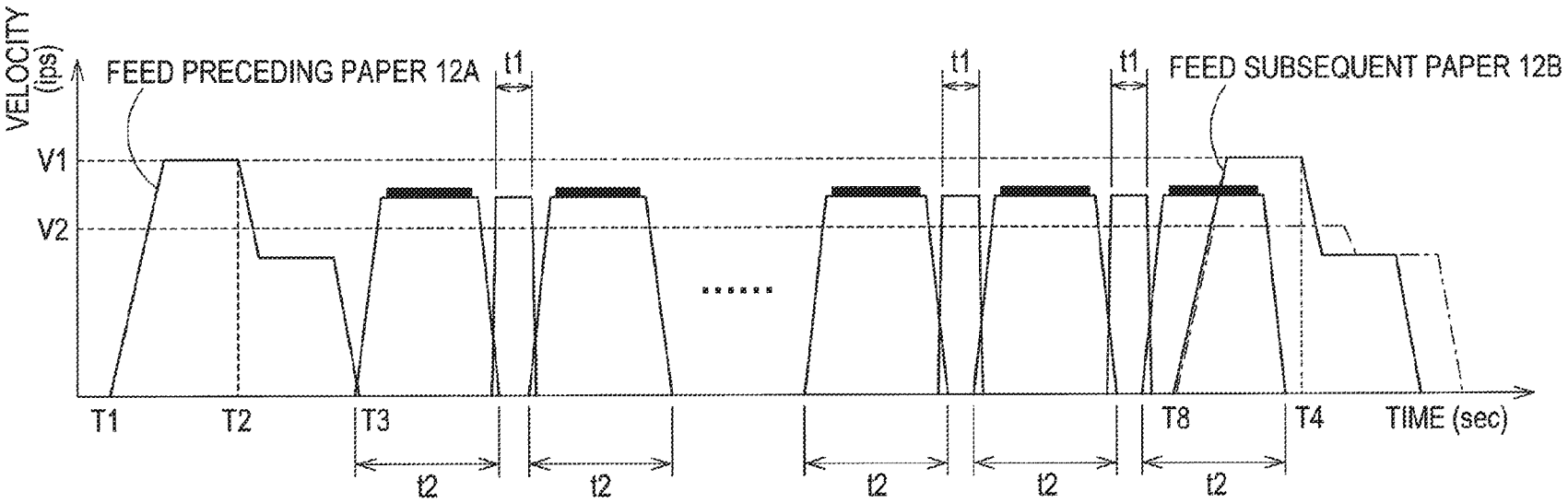
FIG. 10 is a timing chart showing velocities of the feed roller 25, the conveyance roller 60, and the carriage 23 with respect to time from the start of image recording processing in a case where the timing at which subsequent paper 12B contacts the pair of conveyance rollers 54 is not during ejection processing on preceding paper 12A.

In the timing charts of FIGS. 9 and 10, the velocity of paper 12 in conveyance processing (t1), the velocity of the carriage 23 in ejection processing (t2), and the velocity of paper 12 in feed processing are shown in the same graph for simplicity. The magnitude relationship within each of the velocity of paper 12 in conveyance processing (t1), the velocity of the carriage 23 in ejection processing (t2), and the velocity of paper 12 in feed processing is shown. But, the magnitude relationship among the velocity of paper 12 in conveyance processing (t1), the velocity of the carriage 23 in ejection processing (t2), and the velocity of paper 12 in feed processing is not shown. In FIGS. 9 and 10, thick line portions of the velocity of the carriage 23 in the ejection processing (t2) indicate that ink droplets are ejected onto paper 12 during the time periods of the thick line portions.

In response to acquiring a print command for recording an image on paper 12 (S10), the controller 130 executes image recording processing (processing in step S20 and thereafter). A "step" will be abbreviated as "S". The transmission source of the print command is not particularly limited. For example, the print command may be acquired through an operation interface 17 (see FIG. 1) provided on the MFP 10, or may be acquired from an external apparatus through a communication network. The controller 130 controls operations of each roller, the carriage 23, and the head 39 in accordance with the acquired print command, thereby recording an image on paper 12.

The controller 130 executes feed processing of paper 12 (S20, T1). Hereinafter, this paper 12 is referred to as preceding paper 12A (an example of a preceding sheet). The feed processing of the preceding paper 12A is processing for causing the leading end (the downstream end in the conveyance direction 16) of the preceding paper 12A supported on the feed tray 20 to reach the pair of conveyance rollers 54. In S10, the controller 130 controls the conveyance motor 102 to rotate in the reverse direction so as to rotate the feed roller 25. Note that, when the conveyance motor 102 rotates in the reverse direction, the feed roller 25 rotates in the direction for conveying the preceding paper 12A rearward (FIG. 2), and the conveyance roller 60 rotates in the reverse direction, but the discharge roller 62 does not rotate. By rotation of the feed roller 25, the preceding paper 12A is fed to the conveyance path 65.

When the leading end of the preceding paper 12A reaches the pair of conveyance rollers 54, the preceding paper 12A contacts the conveyance roller 60 in reverse rotation (rotating in the reverse direction) and oblique-conveyance of the preceding paper 12A is corrected (S30, T2).

Next, the controller 130 executes conveyance processing (S40). The conveyance processing of the preceding paper 12A is processing of conveying the preceding paper 12A in the conveyance direction 16 by the pair of conveyance rollers 54. In S40, the controller 130 switches the conveyance motor 102 from reverse rotation to forward rotation. With this operation, the feed roller 25 stops, and the conveyance roller 60 and the discharge roller 62 rotate in the forward direction. And, the preceding paper 12A is conveyed to an image recording start position by the pair of conveyance rollers 54. The image recording start position is a position at which the downstream end of an image recording region of paper 12 in the conveyance direction 16 faces the most downstream nozzle 40 in the conveyance direction 16 among the plurality of nozzles 40.

In the present embodiment, the velocity of the preceding paper 12A conveyed by the pair of conveyance rollers 54 in S40 is lower than the velocity of the preceding paper 12A fed by the feed roller 25 in S20. At the time point when the preceding paper 12A reaches the image recording start position, the conveyance motor 102 is stopped so that the preceding paper 12A is stopped (T3).

Next, the controller 130 executes recording processing on the preceding paper 12A (S50). The recording processing on the preceding paper 12A is processing of recording an image on the preceding paper 12A. Specifically, the controller 130 executes conveyance processing and ejection processing alternately and repeatedly.

The conveyance processing is processing of causing at least one of the pair of conveyance rollers 54 and the pair of discharge rollers 55 to convey the preceding paper 12A by a particular line feed width in the conveyance direction 16 (t1). Here, the particular line feed width is determined based on image data included in the print command. In the conveyance processing, the controller 130 controls the conveyance motor 102 to rotate in the forward direction so that each roller 60, 62 rotates in the forward direction.

The ejection processing is processing of causing the head 39 to eject ink onto the preceding paper 12A that is conveyed by the particular line feed width. In the ejection processing, the controller 130 controls the conveyance motor 102 to stop so that each roller 60, 62 stops, controls the carriage motor 103 to drive so that the carriage 23 moves in the left-right direction X (t2), and causes the head 39 to eject ink at particular timing (the thick line portions in FIGS. 9 and 10).

The controller 130 determines whether the preceding paper 12A has passed through the pair of conveyance rollers 54 in the conveyance processing during the recording processing, based on the position of the preceding paper 12A detected based on the detection signal outputted from the sensor 120 and on the pulse signal outputted from the rotary encoder 121 (S60). That is, the controller 130 determines whether the trailing end (the upstream end in the conveyance direction 16) of the preceding paper 12A is located downstream of the nip position of the pair of conveyance rollers 54 in the conveyance direction 16.

In response to determining that the preceding paper 12A has passed through the pair of conveyance rollers 54 (S60: Yes), the controller 130 determines whether the image data included in the print command includes image data that has not yet been recorded on the preceding paper 12A, in other words, whether there is image recording of next page (S70).

In response to determining that there is no image recording of next page (S70: No), the controller 130 executes remaining image recording on the preceding paper 12A by continuing processing similar to S50 (S80). Upon ending the image recording, the controller 130 causes the preceding paper 12A to be conveyed in the conveyance direction 16 and to be discharged onto the discharge tray 21 (S90). With this operation, the image recording processing based on the print command ends.

In response to determining that there is image recording of next page (S70: Yes), the controller 130 executes at least one of first determination processing to fifth determination processing described below so as to determine a feed condition for paper 12 that is fed from the feed tray 20 to the conveyance path 65 next time. Hereinafter, this paper 12 is referred to as "subsequent paper 12B" (an example of a subsequent sheet). Each determination processing is executed before feeding of the subsequent paper 12B is actually started. And, feeding of the subsequent paper 12B is executed by using the determined feed condition.

The controller 130 executes first determination processing (S100). The first determination processing is processing of determining whether, in a case where the subsequent paper 12B is fed at a first timing in a first feed condition, timing (T4) at which the leading end of the subsequent paper 12B contacts the pair of conveyance rollers 54 is during ejection processing on the preceding paper 12A (in other words, whether the timing (T4) overlaps the ejection processing on the preceding paper 12A).

The first timing is timing before recording processing on the preceding paper 12A ends. In other words, the first timing is timing before all the image data to be recorded on the preceding paper 12A is recorded. In the present embodiment, the first timing is timing immediately after the end of conveyance processing that is executed recently.

The first feed condition is a condition that paper 12 is fed at the first timing at a first velocity V1. The first velocity V1 is a feed velocity that is normally used. That is, if there is no problem, paper 12 is fed at the first velocity V1. Thus, the preceding paper 12A that is the first sheet of paper 12 recorded based on a print command is fed at the first velocity V1.

In response to determining that the timing (T4) is during ejection processing on the preceding paper 12A in S100 (S100: Yes, T4 in FIG. 9), the controller 130 executes second determination processing (S110). The second determination processing is processing of determining whether, in a case where the subsequent paper 12B is fed in a second feed condition, a second timing that is feed start timing in the second feed condition is during ejection processing on the preceding paper 12A.

The second feed condition is a condition that paper 12 is fed at a second timing at the first velocity V1, instead of the first timing. In FIG. 9, the first timing of feed start of the subsequent paper 12B is T5, and the second timing of feed start of the subsequent paper 12B is T6.

The second timing T6 is timing that is a particular time t3 (see FIG. 9) after the first timing T5. The particular time t3 is time between the end timing (T7) of ejection processing that is executed next time and the timing (T4) at which the leading end of the subsequent paper 12B contacts the pair of conveyance rollers 54 in a case where the subsequent paper 12B is fed in the first feed condition. That is, the particular time t3 is equal to T7−T4. Alternatively, the particular time t3 may be obtained by adding a particular delay time α to T7−T4. That is, the particular time t3 may be T7−T4+α.

In FIG. 9, the timing chart of feeding the subsequent paper 12B in a case where the subsequent paper 12B is fed in the second feed condition is shown by broken lines.

In response to determining that the second timing T6 is not during ejection processing on the preceding paper 12A in S110 (S110: No, see FIG. 9), the controller 130 controls the conveyance motor 102 to rotate in the reverse direction so as to feed the subsequent paper 12B in the second feed condition (S120). In this case, because the feed start timing of the subsequent paper 12B is the second timing T6, the timing (T4') at which the leading end of the subsequent paper 12B contacts the pair of conveyance rollers 54 is the same timing as the end of ejection processing on the preceding paper 12A (T7) or is the delay time α after the end of ejection processing on the preceding paper 12A.

In response to determining that the second timing T6 is during ejection processing on the preceding paper 12A in S110 (S110: Yes), the controller 130 executes third determination processing (S130). The third determination processing is processing of determining, based on a signal from the sensor 125, whether the stacked amount of paper 12 on the feed tray 20 is larger than or equal to a set amount.

In response to determining that the stacked amount of paper 12 on the feed tray 20 is larger than or equal to the set amount (S130: Yes), the controller 130 controls the conveyance motor 102 to rotate in the reverse direction and to feed the subsequent paper 12B in the second feed condition (S120, the timing chart of the broken lines in FIG. 9).

In response to determining that the stacked amount of paper 12 on the feed tray 20 is smaller than the set amount (S130: No), the controller 130 controls the conveyance motor 102 to rotate in the reverse direction and to feed the subsequent paper 12B in a third feed condition (S140).

The third feed condition is a condition that paper 12 is fed at a second velocity V2 at the first timing, instead of the first velocity V1. The second velocity V2 is lower than the first velocity V1. In FIG. 9, the timing chart of feeding the subsequent paper 12B in a case where the subsequent paper 12B is fed in the third feed condition is shown by single-dot chain lines. As in the case where the subsequent paper 12B is fed in the second feed condition, in a case where the subsequent paper 12B is fed in the third feed condition, the timing (T4') at which the leading end of the subsequent paper 12B contacts the pair of conveyance rollers 54 is the same timing as the end of ejection processing on the preceding paper 12A or after the end of ejection processing on the preceding paper 12A.

If timing (T4) is not during ejection processing on the preceding paper 12A in S100 (S100: No, T4 in FIG. 10), the controller 130 executes fourth determination processing (S180). The fourth determination processing is processing of determining whether, in a case where the subsequent paper 12B is fed in the first feed condition, the first timing that is feed start timing in the first feed condition is during ejection processing on the preceding paper 12A. In FIG. 10, the first timing of feed start of the subsequent paper 12B is T8.

In response to determining that the first timing T8 is not during ejection processing on the preceding paper 12A (S180: No), the controller 130 controls the conveyance motor 102 to rotate in the reverse direction so as to feed the subsequent paper 12B in the first feed condition (S190).

In response to determining that the first timing T8 is during ejection processing on the preceding paper 12A (S180: Yes, see FIG. 10), the controller 130 executes fifth determination processing (S200). The fifth determination processing is processing similar to the third determination processing (S130), and is processing of determining whether the stacked amount of paper 12 on the feed tray 20 is larger than or equal to a set amount.

In response to determining that the stacked amount of paper 12 on the feed tray 20 is larger than or equal to the set amount (S200: Yes), the controller 130 controls the conveyance motor 102 to rotate in the reverse direction so as to feed the subsequent paper 12B in the first feed condition (S190). In FIG. 10, the timing chart of feeding the subsequent paper 12B in a case where the subsequent paper 12B is fed in the first feed condition is shown by solid lines.

In response to determining that the stacked amount of paper 12 on the feed tray 20 is smaller than the set amount (S200: No), the controller 130 controls the conveyance motor 102 to rotate in the reverse direction so as to feed the subsequent paper 12B in the third feed condition (S210). In FIG. 10, the timing chart of feeding the subsequent paper 12B in a case where the subsequent paper 12B is fed in the third feed condition is shown by single-dot chain lines.

When the leading end of the subsequent paper 12B fed in S120, S140, S180, or S210 reaches the pair of conveyance rollers 54, the subsequent paper 12B contacts the conveyance roller 60 that is rotating in the reverse direction and thereby oblique conveyance of the subsequent paper 12B is corrected (S150).

After the oblique-conveyance correction, the controller 130 switches the conveyance motor 102 from reverse rotation to forward rotation. With this operation, the feed roller 25 stops, and the conveyance roller 60 and the discharge roller 62 rotate in the forward direction. The controller 130 performs remaining image recording on the preceding paper 12A (S160) while alternately executing ejection processing and conveyance processing, and thereafter executes recording processing on the subsequent paper 12B (S170).

In a similar manner to S60, the controller 130 determines whether the subsequent paper 12B has passed through the pair of conveyance rollers 54 in the conveyance processing during the recording processing, based on the position of the subsequent paper 12B detected based on the detection signal outputted from the sensor 120 and on the pulse signal outputted from the rotary encoder 121 (S220). That is, the controller 130 determines whether the trailing end (the upstream end in the conveyance direction 16) of the subsequent paper 12B is located downstream of the nip position of the pair of conveyance rollers 54 in the conveyance direction 16.

In response to determining that the subsequent paper 12B has passed through the pair of conveyance rollers 54 (S220: Yes), the controller 130 determines whether the image data included in the print command includes image data that has not yet been recorded on the subsequent paper 12B, in other words, whether there is image recording of next page (S230).

In response to determining that there is image recording of next page (S230: Yes), the controller 130 repeatedly executes processing in the above-described S100 and thereafter. In the present embodiment, once the preceding paper 12A is discharged onto the discharge tray 21, the subsequent paper 12B fed subsequent to the preceding paper 12A is treated as the preceding paper 12A. That is, after the processing shifts from S230 to S100, the paper 12 that has been treated as the subsequent paper 12B until shifting from S230 to S100 is regarded as the preceding paper 12A, and the processing thereafter is executed.

In response to determining that there is no image recording of next page (S230: No), the controller 130 executes remaining image recording on the subsequent paper 12B (S240). Upon ending the image recording, the controller 130 causes the subsequent paper 12B to be conveyed in the conveyance direction 16 and to be discharged onto the discharge tray 21 (S90). With this operation, image recording processing based on the print command ends.

[Effects of Embodiment]

According to the present embodiment, the feed start timing of the subsequent paper 12B is set after the particular timing (S120), or the feed velocity of the subsequent paper 12B is lowered (S140, S210), thereby the timing at which the subsequent paper 12B contacts the pair of conveyance rollers 54 is shifted to a later timing. This prevents the subsequent paper 12B from contacting the pair of conveyance rollers 54 during recording processing on the preceding paper 12A. In this way, an influence on the image quality recorded on the preceding paper 12A can be prevented. That is, in a case where successive feeding of paper is performed, an influence on the image quality recorded on the preceding paper 12A arising from feeding and conveyance of the subsequent paper 12B can be prevented.

Further, the timing at which the subsequent paper 12B contacts the pair of conveyance rollers 54 is set to the timing of conveyance of the preceding paper 12A by the particular line feed width (not the timing during ejection processing). Thus, an influence on the image quality recorded on the preceding paper 12A can be prevented.

Further, in a case where feeding of the subsequent paper 12B is started by the feed roller 25 during ejection processing onto the preceding paper 12A (S110: Yes, S180: Yes), there is a possibility that the MFP 10 vibrates due to slip and so on of the feed roller 25 at the time of start of feeding and this vibration affects the image quality recorded on the preceding paper 12A. According to the present embodiment, in such cases, the drive state of the feed roller 25 is changed from the first feed condition and the second feed condition (S140, S210), thereby preventing slip and so on of the feed roller 25.

Regarding slip and so on of the feed roller 25 in a case where feeding of the subsequent paper 12B is started by the feed roller 25 during ejection processing on the preceding paper 12A, it is unlikely that such slip occurs when the stacked amount of paper 12 supported on the feed tray 20 is large. Thus, in such a case (S130: Yes, S200: Yes), feed processing for the subsequent paper 12B is executed in the first feed condition or the second feed condition (S190, S120), so that unnecessary changes of the drive state of the feed roller 25 can be prevented.

In contrast, it is likely that slip and so on of the feed roller 25 occurs when the stacked amount of paper 12 supported on the feed tray 20 is small. In such a case (S130: No, S200: No), feed processing on the subsequent paper 12B is executed in the third feed condition (S210, S140), an influence on the image quality recorded on the preceding paper 12A can be prevented.

In S140 and S210, by lowering the rotation velocity of the feed roller 25, slip and so on of the feed roller 25 can be reduced.

According to the present embodiment, driving force can be transmitted to both the feed roller 25 and the conveyance roller 60 with a single motor (the conveyance motor 102).

According to the present embodiment, vibrations that occur when the subsequent paper 12B is pressed against the pair of conveyance rollers 54 tend to be transmitted to the recording unit 24 through the pair of side frames 46 and the guide rails 43, 44, which tends to affect the image quality recorded on the preceding paper 12A. As described above, however, the subsequent paper 12B is prevented from contacting the pair of conveyance rollers 54 during recording processing on the preceding paper 12A, which prevents an influence on the image quality recorded on the preceding paper 12A.

According to the present embodiment, vibrations due to distortion of the feed arm 26 or slip and so on of the feed roller 25 tend to be transmitted to the recording unit 24 through the frame 45, which causes an influence on the image quality recorded on the preceding paper 12A. As described above, however, by changing the drive state of the feed roller 25 from the first feed condition and the second feed condition, the slip and so on of the feed roller 25 is prevented, thereby preventing an influence on the image quality recorded on the preceding paper 12A.

[Modification]

While the disclosure has been described in detail with reference to the above aspects thereof, it would be apparent to those skilled in the art that various changes and modifications may be made therein without departing from the scope of the claims.

In the above-described embodiment, the second determination processing (S110) is executed in a case where the timing at which the leading end of the subsequent paper 12B contacts the pair of conveyance rollers 54 is during ejection processing on the preceding paper 12A (S100: Yes) in the first determination processing (S100). Alternatively, in such a case, the subsequent paper 12B may be fed in the second feed condition (S120) or the third feed condition (S140) without executing the second determination processing (S110).

In the above-described embodiment, the fourth determination processing (S180) is executed in a case where the timing at which the leading end of the subsequent paper 12B contacts the pair of conveyance rollers 54 is not during ejection processing on the preceding paper 12A (S100: No) in the first determination processing (S100). Alternatively, in such a case, the subsequent paper 12B may be fed in the first feed condition (S190) or the third feed condition (S210) without executing the fourth determination processing (S180).

In the above-described embodiment, the third determination processing (S130) is executed in a case where the second timing is during ejection processing on the preceding paper 12A (S110: Yes) in the second determination processing (S110). Alternatively, in such a case, the subsequent paper 12B may be fed in the third feed condition (S140) without executing the third determination processing (S130).

In the above-described embodiment, the fifth determination processing (S200) is executed in a case where the first timing is during ejection processing on the preceding paper 12A (S180: Yes) in the fourth determination processing (S180). Alternatively, in such a case, the subsequent paper 12B may be fed in the third feed condition (S210) without executing the fifth determination processing (S200).

In the above-described embodiment, in S140 and S210, the subsequent paper 12B is fed in the third feed condition. Alternatively, in S140 and S210, a fourth feed condition may be executed.

The fourth feed condition is a condition that the drive state of the feed roller 25 is changed so as to suppress vibrations of the MFP 10 during feed processing as compared with the first feed condition and the second feed condition.

For example, the fourth feed condition may be a condition that paper 12 is fed at the second velocity V2 instead of the first velocity V1. That is, the fourth feed condition may be the third feed condition as described in the above embodiment.

The fourth feed condition may be a condition that an acceleration of the feed roller 25 from the start of rotation to a constant velocity state is a second acceleration that is lower than a first acceleration in the first feed condition and the second feed condition. In this case, in FIGS. 9 and 10, the slope of rising of the timing chart showing the feed velocity of paper 12 is smaller.

By lowering the acceleration of the feed roller 25, the slip and so on of the feed roller 25 can be reduced.

Alternatively, the fourth feed condition may be a condition that the feed roller 25 is driven with a current that is obtained by cutting a current exceeding a particular limiting current out of a driving current to be supplied to the feed roller 25. In this case, the MFP 10 includes a current limiting circuit. In a case where the subsequent paper 12B is fed in the fourth feed condition, during driving of the feed roller 25 (during reverse rotation of the conveyance motor 102), the controller 130 controls such that a driving current is supplied from a power supply (not shown) of the MFP 10 to the conveyance motor 102 through the current limiting circuit. With this operation, the current exceeding the limiting current out of the driving current to be supplied to the feed roller 25 is cut. In a case where the subsequent paper 12B is fed in a condition other than the fourth feed condition, during driving of the feed roller 25 (during reverse rotation of the conveyance motor 102), the controller 130 controls such that the driving current is supplied from the power supply (not shown) of the MFP 10 to the conveyance motor 102 without passing through the current limiting circuit.

If distortion, slip, and so on occur in the feed roller 25 due to the force between the feed roller 25 and the feed tray 20 (or paper 12 supported on the feed tray 20) in contact with each other, there is a possibility that an excessive driving current is supplied to the feed roller 25 and then the feed roller 25 locks. According to the above-described modification, in the fourth feed condition, the feed roller 25 is driven with the current that is obtained by cutting the current exceeding the limiting current out of the driving current to be supplied to the feed roller 25, thereby preventing the above-mentioned lock.

In the above-described embodiment, the feed roller 25 and the conveyance roller 60 are driven by a common motor (the conveyance motor 102). Thus, feeding of the subsequent paper 12B is performed after the preceding paper 12A passes through the pair of conveyance rollers 54. Alternatively, the feed roller 25 may be driven by a different motor from the conveyance motor 102. In this case, feeding of the subsequent paper 12B may be performed before the preceding paper 12A passes through the pair of conveyance rollers 54. In this case, too, the controller 130 changes the feed condition of the subsequent paper 12B based on the determination result in the first determination processing to the fifth determination processing, as in the above-described embodiment.

In the above-described embodiment, the MFP 10 is a so-called serial head type including the head 39 and the carriage 23. Thus, in the first determination processing (S100), the second determination processing (S110), and the fourth determination processing (S180), it is determined whether the particular timing is during ejection processing which is one of ejection processing and conveyance processing that are executed alternately in recording processing. That is, it is determined that the condition is satisfied if the particular timing is during ejection processing, and it is determined that the condition is not satisfied if the particular timing is during conveyance processing, not during ejection processing. Alternatively, the MFP 10 may be a so-called line head type not including the carriage 23. In this case, ejection processing and conveyance processing are executed in parallel in recording processing. Thus, if the particular is during recording processing, it is determined that the condition is satisfied regardless of whether conveyance processing is being executed.

In the above-described embodiment, the MFP 10 records an image on paper 12 with an inkjet recording method. Alternatively, the printer unit 11 may record an image on paper 12 with a method other than the inkjet recording method. For example, the printer unit 11 may record an image on paper 12 with an electro-photographic method. In this case, as in the case where the MFP 10 is a line head type, it is determined that the condition is satisfied if the particular timing is during recording processing.

What is claimed is:

1. An image recording apparatus comprising:

a tray configured to support sheets;

a feed roller configured to feed sheets supported on the tray;

a pair of conveyance rollers located on a conveyance path through which sheets pass;

a print engine located downstream of the pair of conveyance rollers on the conveyance path in a conveyance direction of sheets; and a controller configured to:

control the feed roller to rotate to perform feeding of a preceding sheet supported on the tray to the conveyance path;

control the pair of conveyance rollers to rotate to convey the preceding sheet fed by the feed roller in the conveyance direction through the conveyance path;

control the print engine to perform recording of an image on the preceding sheet that is conveyed by the pair of conveyance rollers;

before feeding a subsequent sheet from the tray, determine whether or not the subsequent sheet would contact the pair of conveyance rollers during the recording on the preceding sheet if the subsequent sheet were fed using a first feed condition, the subsequent sheet being a sheet that follows the preceding sheet, the first feed condition being a condition in which the feeding of the subsequent sheet from the tray is started at a first timing before the recording on the preceding sheet ends and at a first velocity; and in response to determining that the subsequent sheet would contact the pair of conveyance rollers during the recording on the preceding sheet if the subsequent sheet were fed using the first feed condition, control the feed roller to perform the feeding of the subsequent sheet, from the tray, in one of a second feed condition and a third feed condition, the second feed condition being a condition that the feeding of the subsequent sheet from the tray is started at a second timing that is later than the first timing, the third feed condition being a condition that the subsequent sheet is fed at a second velocity that is lower than the first velocity.

2. The image recording apparatus according to claim 1, wherein the print engine includes:

a head configured to eject ink droplets; and a carriage on which the head is mounted, the carriage being configured to move in a scanning direction intersecting the conveyance direction; and wherein the controller is configured to:

in the recording, alternately perform conveyance of a sheet by a particular line feed width and ejection of ink droplets from the head while moving the carriage in the scanning direction; and in response to determining, before feeding the subsequent sheet, that the subsequent sheet would contact the pair of conveyance rollers during the ejection on the preceding sheet if the subsequent sheet were fed using the first feed condition, perform the feeding of the subsequent sheet in one of the second feed condition and the third feed condition.

3. The image recording apparatus according to claim 2, wherein the controller is configured to:

determine whether or not the second timing is during the ejection on the preceding sheet; and in response to determining that the second timing is during the ejection on the preceding sheet, perform the feeding of the subsequent sheet in a fourth feed condition, the fourth feed condition being a condition that a drive state of the feed roller is different such that vibrations to the image recording apparatus during the feeding are suppressed than cases where the feeding is performed in the first feed condition and in the second feed condition.

4. The image recording apparatus according to claim 3, wherein the controller is configured to:

in response to determining that the second timing is during the ejection on the preceding sheet, determine whether a stacked amount of sheets supported on the tray is larger than or equal to a particular set amount;

in response to determining that the stacked amount of sheets is smaller than the set amount, perform the feeding of the subsequent sheet in the fourth feed condition; and in response to determining that the stacked amount of sheets is larger than or equal to the set amount, perform the feeding of the subsequent sheet in the second feed condition.

5. The image recording apparatus according to claim 3, wherein the fourth feed condition is a condition that the subsequent sheet is fed at the second velocity.

6. The image recording apparatus according to claim 3, wherein, in the first feed condition and the second feed condition, the feed roller accelerates at a first acceleration from start of rotation to a constant velocity state; and wherein the fourth feed condition is a condition that the feed roller accelerates at a second acceleration from start of rotation to a constant velocity state, the second acceleration being lower than the first acceleration.

7. The image recording apparatus according to claim 3, wherein the fourth feed condition is a condition that the feed roller is driven with a current that is obtained by cutting a part of a driving current to be supplied to the feed roller, the part exceeding a particular limiting current.

8. The image recording apparatus according to claim 2, wherein the controller is configured to:

determine whether the first timing is during the ejection on the preceding sheet; and in response to determining that the first timing is during the ejection on the preceding sheet, perform the feeding of the subsequent sheet in a fourth feed condition, the fourth feed condition being a condition that a drive state of the feed roller is different such that vibrations to the image recording apparatus during the feeding are suppressed than cases where the feeding is performed in the first feed condition and in the second feed condition.

9. The image recording apparatus according to claim 8, wherein the fourth feed condition is a condition that the subsequent sheet is fed at the second velocity.

10. The image recording apparatus according to claim 8, wherein the controller is configured to:

in response to determining that the first timing is during the ejection on the preceding sheet, determine whether a stacked amount of sheets supported on the tray is larger than or equal to a particular set amount;

in response to determining that the stacked amount of sheets is smaller than the set amount, perform the feeding of the subsequent sheet in the fourth feed condition; and in response to determining that the stacked amount of sheets is larger than or equal to the set amount, perform the feeding of the subsequent sheet in the first feed condition.

11. The image recording apparatus according to claim 2, wherein the controller is configured to control the feed roller to perform the feeding of the subsequent sheet in one of the second feed condition and the third feed condition, such that the subsequent sheet contacts the pair of conveyance rollers during the conveyance of the preceding sheet by the particular line feed width.

12. The image recording apparatus according to claim 1, wherein the pair of conveyance rollers includes a conveyance roller;

wherein the image recording apparatus further comprises:

a motor configured to rotate in a forward direction and in a reverse direction; and a driving transmission mechanism configured to transmit driving force of the motor to the feed roller and the conveyance roller;

wherein, when the driving transmission mechanism transmits driving force of the motor rotating in the forward direction, the conveyance roller rotates in a rotation direction of conveying a sheet in the conveyance direction and the feed roller stops;

wherein, when the driving transmission mechanism transmits driving force of the motor rotating in the reverse direction, the conveyance roller stops or rotates in an opposite direction opposite from the rotation direction and the feed roller rotates in a direction of feeding a sheet to the conveyance path; and wherein the controller is configured to, in response to determining that the preceding sheet has passed through the pair of conveyance rollers, control the motor to rotate in the reverse direction so as to start the feeding of the subsequent sheet.

13. The image recording apparatus according to claim 1, further comprising:

a first frame rotatably supporting a roller constituting the pair of conveyance rollers; and a second frame formed as an integral part with the first frame or coupled to the first frame, the second frame supporting the print engine.

14. The image recording apparatus according to claim 13, further comprising:

a third frame formed as an integral part with the first frame or coupled to the first frame; and an arm having a base end and a distal end, the base end being pivotally supported by the third frame, the distal end rotatably supporting the feed roller, wherein the arm extends diagonally downward from the base end toward the distal end in a sheet feed direction in which the feed roller feeds a sheet.

15. The image recording apparatus according to claim 1, wherein the controller is configured to:

determine whether the second timing is during the recording on the preceding sheet; and in response to determining that the second timing is during the recording on the preceding sheet, perform the feeding of the subsequent sheet in a fourth feed condition, the fourth feed condition being a condition that a drive state of the feed roller is different such that vibrations to the image recording apparatus during the feeding are suppressed than cases where the feeding is performed in the first feed condition and in the second feed condition.

16. The image recording apparatus according to claim 15, wherein the controller is configured to:

in response to determining that the second timing is during the recording on the preceding sheet, determine whether a stacked amount of sheets supported on the tray is larger than or equal to a particular set amount;

in response to determining that the stacked amount of sheets is smaller than the set amount, perform the feeding of the subsequent sheet in the fourth feed condition; and in response to determining that the stacked amount of sheets is larger than or equal to the set amount, perform the feeding of the subsequent sheet in the second feed condition.

17. The image recording apparatus according to claim 15, wherein the fourth feed condition is a condition that the subsequent sheet is fed at the second velocity.

18. The image recording apparatus according to claim 15, wherein, in the first feed condition and the second feed condition, the feed roller accelerates at a first acceleration from start of rotation to a constant velocity state; and wherein the fourth feed condition is a condition that the feed roller accelerates at a second acceleration from start of rotation to a constant velocity state, the second acceleration being lower than the first acceleration.

19. The image recording apparatus according to claim 15, wherein the fourth feed condition is a condition that the feed roller is driven with a current that is obtained by cutting a part of a driving current to be supplied to the feed roller, the part exceeding a particular limiting current.

* * * * *